US006511713B2

(12) United States Patent
Mathisen et al.

(10) Patent No.: US 6,511,713 B2
(45) Date of Patent: Jan. 28, 2003

(54) PRODUCTION OF PATTERNED COATED ABRASIVE SURFACES

(75) Inventors: Mark E. Mathisen, Franklin, MA (US); Gwo Shin Swei, East Amherst, NY (US)

(73) Assignee: Saint-Gobain Abrasives Technology Company, Worcester, MA (US)

( * ) Notice: Subject to any disclaimer, the term of this patent is extended or adjusted under 35 U.S.C. 154(b) by 10 days.

(21) Appl. No.: 09/824,272

(22) Filed: Apr. 2, 2001

(65) Prior Publication Data

US 2002/0142103 A1 Oct. 3, 2002

(51) Int. Cl.[7] ..... B05D 1/06

(52) U.S. Cl. ..... 427/466; 427/469; 427/475; 51/295

(58) Field of Search ..... 427/466, 467, 427/469, 475, 477, 479, 482; 51/295; 361/225, 226; 118/624, 625, 627, 629, 638, 644, 649

(56) References Cited

U.S. PATENT DOCUMENTS 4,826,703 A * 5/1989 Kisler
5,011,513 A * 4/1991 Zador et al.
5,817,374 A * 10/1998 Detig et al.

* cited by examiner

*Primary Examiner*—Fred J. Parker
(74) *Attorney, Agent, or Firm*—David Bennett

(57) ABSTRACT

An electrostatic abrasive grain upward projection deposition process utilizing opposed electrodes produces a patterned abrasive surface by controlling the local intensity of the field by which the grain is projected on to a substrate.

9 Claims, 5 Drawing Sheets

PRODUCTION OF PATTERNED COATED ABRASIVE SURFACES

BACKGROUND

This invention relates to coated abrasives and specifically to a method or making coated abrasives with a patterned surface.

It is well known that there are significant advantages to be obtained from the selective deposition of abrasive materials on a substrate. These may range from the avoidance of wasted grain by non-deposition on the parts of a substrate that do not see active abrasion during conventional use, to the creation of islands of abrasive material that ensure efficient use of the abrasive grain and room for swarf to be carried away during grinding. The present invention provides a very efficient and versatile way of producing patterned coated abrasive surfaces that can be adapted to all manner of coated abrasive applications.

In the production of a conventional coated abrasive, a backing is provided with a maker coat, the primary function of which is to bind abrasive grain deposited thereon to the backing. The grain is therefore applied before the maker coat is fully cured so that it still allows the grain to stick to its surface. A size coat is then applied over the grain adhered to the maker coat and primary function of this coat is to anchor the grain to the backing. It will be clear therefore that, if a maker coat is applied in a pattern rather than as a uniform coating over the backing material, the grain deposited thereon will only adhere to the pattern in which the maker coat has been deposited. This provides a known avenue for the production of patterned surfaces. It does however mean that non-adhered abrasive grain has to be collected and separated from the backing while the manufacturing process is continuing. This can lead to problems and is generally inefficient. In addition the selective printing of specific areas with maker coat is not simple since it means that, instead of using a simple roll-coater with a doctor knife to secure uniformity or a slit die deposition mechanism, several deposition orifices must be kept free-flowing to secure a uniform patterned coated abrasive surface.

An alternative process involves the use of a masking layer which allows deposition of maker coat and/or abrasive grain only in places corresponding to holes in the masking layer. This can be quite effective but the removal of the masking layer can lead to problems if there has been penetration behind the layer that could cause the layer to be difficult to remove, or if there has been some overlap such that removal of the layer causes some of the abrasive also to become dislodged. In addition the masking layer may not be reusable unless carefully cleaned and this represents an unnecessary inconvenience and expense.

Grain deposition is generally practised by gravity feed or by electrostatic deposition. In a gravity feed process the grain is deposited from a deposition hopper in a uniform manner, though this depends on ensuring that the grain remains free-flowing. The tendency is however to over-deposit such that, when the substrate surface passes over a roll to reverse the direction of travel, the coated surface faces downwards and excess grain not adhered by the maker coat drops off. It has been proposed to deposit grain selectively on the substrate using a series of directed shrouds so as to obtain a desired pattern. In such a process the backing is generally uniformly coated with the maker coat such that the production of a patterned surface is a function of the physical control of deposition of grain on to the maker coat.

While such processes are quite efficient, the use becomes more problematical as the abrasive grain size becomes smaller since the smaller grains are more susceptible to flow problems that could lead to pattern disruption. In addition there is the possible problem of over-application and lack of definition of the pattern unless the shroud positioning and the line speed are adequately controlled.

In an electrostatic deposition process, often referred to as an UP (upward projection) process, a tray containing abrasive grain is located between two electrodes with the upper electrode being grounded and the lower adapted to carry a charge. A backing that has been given a maker coat is passed between the electrodes and above the tray of abrasive grain. To initiate grain deposition the lower electrode is charged and abrasive grain is projected upwardly in the direction of the ground electrode and becomes adhered to the maker coat on the substrate. This gives a very uniform, controllable coating and is widely practised for that reason. It is not readily adapted to producing patterns however unless through the use of patterned maker coat depositions, which suffer from the drawbacks outlined above.

The present invention provides an extremely versatile and efficient process for the production of patterned surfaces on a coated abrasive using an efficient UP deposition technique.

GENERAL DESCRIPTION OF THE INVENTION

The present invention provides a process for the production of a coated abrasive having a patterned surface which comprises depositing abrasive grain on a substrate by an electrostatic projection technique wherein the field by which the grain is projected is controlled to provide that the grain is preferentially deposited in the desired pattern.

In essence the pattern is created by the generation of a non-homogenous electrostatic deposition field corresponding to the pattern. The "pattern" can be a simple peripheral ring around an abrasive disc or of lines along the edges of an abrasive sheet. Alternatively it can be a pattern of dots, with each dot having any desired configuration and the pattern elements having any desired spacing. The definition of each element of the pattern is not necessarily crisp because electrostatic fields between electrodes are not defined by clear lines of demarcation. There is however a clearly higher level of deposition corresponding to the areas of greatest electrostatic field intensity and this is the basis of the "pattern" as the term is used herein.

In the context of the present invention the term "non-homogeneous" is intended to convey intentional imposed variations in the intensity of the electrostatic field by which abrasive grain is projected towards the backing. It does not relate to edge effects that are often observed in the areas around the edges of the electrodes, where there may be some attenuation of the strength of the field.

The variations can be brought about in a number of ways, each of which can provide significant advantages for different applications. The field can for example be essentially uniform between conventional electrodes but be locally intensified by the passage of a treated deposition substrate between the electrodes. Thus for example a backing having first and second major surfaces with a maker coat applied to the first major surface and a pattern printed on the second major surface in a conductive ink will, as it passes between the electrodes, locally intensify the field and therefore the deposition on the first major surface opposite the printed areas. If the field strength is adjusted such that, in the absence of the local intensification, it is insufficient to bring about significant deposition of the grain on the substrate, grain will be deposited in a pattern that corresponds to the pattern printed on the reverse side of the film. This pattern can be as simple as a series of dots or stripes or perhaps more complex patterns as desired. Sometimes it may be desirable to print stripes along the lateral edges of a sheet to ensure enhanced deposition in an area that is often inadequately provided with abrasive grain when using conventional UP processes. The printing is most frequently applied to the back side of the substrate, that is the side opposite to that on which the abrasive grain is to be deposited. This however is not essential and printing on the side to receive the grain can often have advantages.

This embodiment of the process is particularly effective when the backing is a plastic film or paper rather than a fabric material which may produce a less intense local variation of the field and therefore less clear definition of the desired pattern.

Creating the pattern using conductive ink printing has the great advantage of being extremely versatile and, since it employs conventional UP deposition equipment, can be used in conjunction with a suitable printing station to generate any desired pattern without extensive modification of the UP grain deposition equipment between runs of different patterns.

The process of the invention is well adapted for use in a continuous process such as the conventional coated abrasive production technique which generates a large roll, (called a "jumbo"), of coated abrasive which is then cut and/or spliced to produce abrasive discs or belts. It can also be used in the production of individual discs in which individual discs of backing material are placed in the UP grain deposition field to receive the abrasive grain. These discs can receive appropriate patterns in conductive ink before being inserted in the field.

An alternative method of varying the intensity of the electrostatic field is through the use of shaped electrodes. In its simplest embodiment, the ground electrode is ring-shaped. If this is to be used in a continuous process, the field will need to be generated in interrupted fashion and coordinated with passage of the backing between the electrodes. It is however possible to produce individual discs that have been pre-cut and positioned on a conveyor passing between the electrodes providing the timing of deposition can be accurately controlled to correspond with the position of the disc.

The patterned electrode can be either the live electrode or the ground, with the same result. A further refinement would be to have similar patterns on both live and ground electrodes.

Patterned electrodes can be readily fashioned by patterned printing using conductive ink on an insulating substrate such as a polyester or polyvinylidenefluoride film. Alternatively a metal-coated insulating film can be etched to give the desired pattern. Other techniques well-known in the art can also be employed to make patterned electrodes.

A particularly effective patterned electrode has the form of a laminate in which a common support, or base, layer of a conductive material is overlaid by an insulating material with conductive projections through insulating layer providing on the surface a pattern of conductive segments in electrical contact with the conductive base layer. In a simple form, the surface of the electrode is a series of small plates, which are in effect, mini-electrodes uniformly spaced and separated by insulating material. As before the patterned electrode can be the ground electrode or the live electrode or possibly both. As before these electrodes are adapted for use either in continuous production mode in the form of a jumbo roll or in the production of individual discs in a carefully registered approach.

DESCRIPTION OF PREFERRED EMBODIMENTS

The invention is now described with particular reference to the Drawings which illustrate some of the potential combinations and applications of the invention. They do not of course represent an exhaustive summary of the options that would be obvious to the man of skill in the art based on the disclosures they contain.

Figure 1:
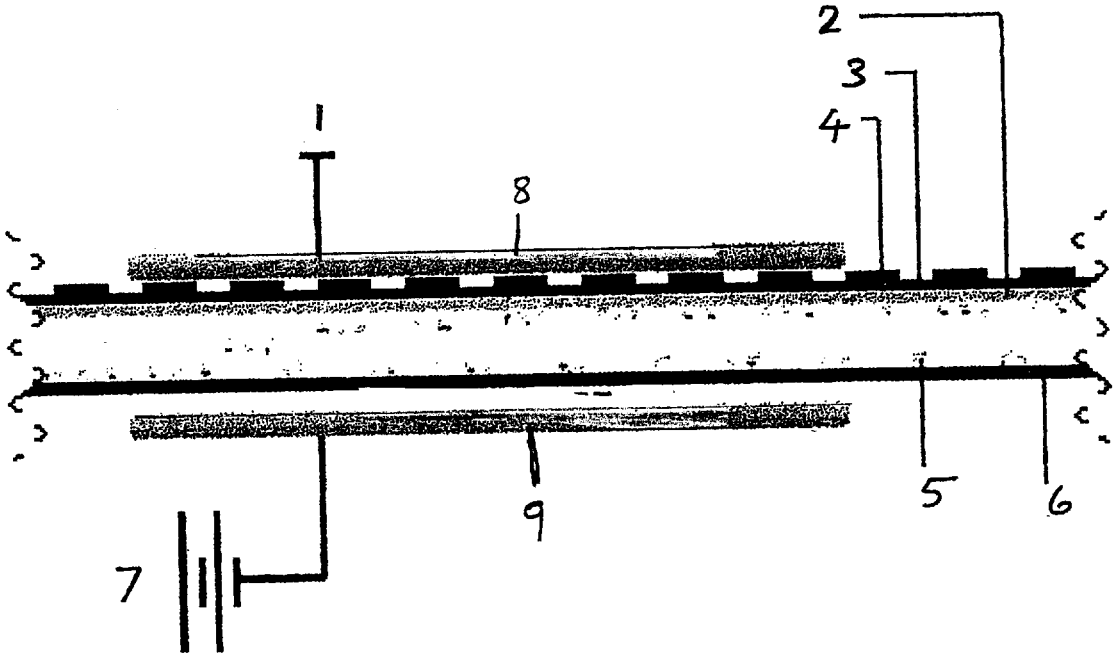
FIG. 1 is a diagrammatic view of a continuous process using a back-printed backing material.

In FIG. 1 an electrode, 8, connected to earth, 1, is opposed by live electrode, 9, connected to a power source, 7. A grain conveyor, 6, bearing grain, 5, passes between the electrodes adjacent the live electrode. A coated abrasive backing material, 3, having a layer of an uncured maker coat, 2, and a pattern, 4, imprinted on the back in a conductive ink, passes between the electrodes adjacent the grounded electrode. As the patterned portions of the backing enter the zone between the electrodes, grain is projected from the conveyor to be deposited on the maker coat in the areas opposed to the printed pattern on the opposite side of the backing.

Figure 2A:
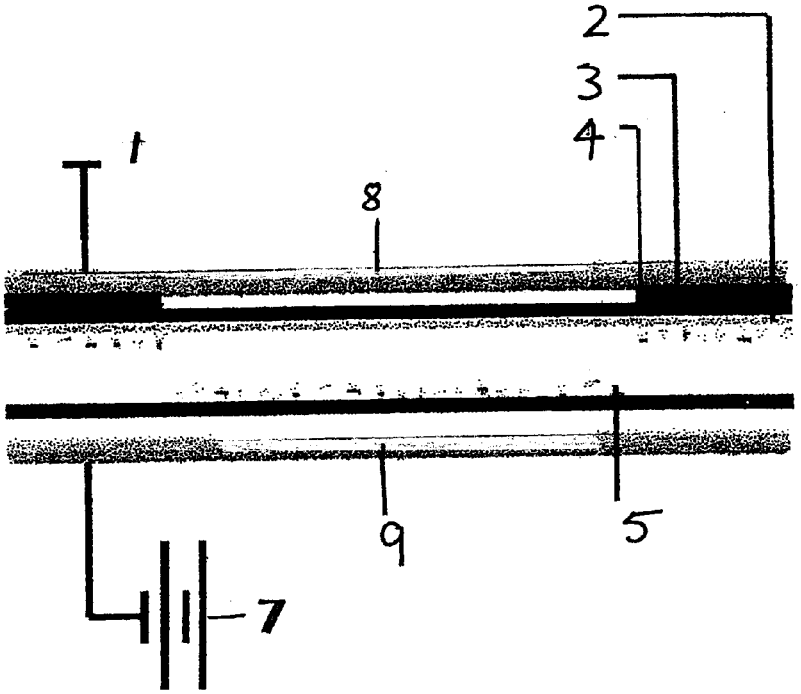
FIG. 2*a* shows a set-up for producing individual discs with abrasive grain deposited predominantly around the edge of a disc with the appropriate back printing.
Figure 2B:
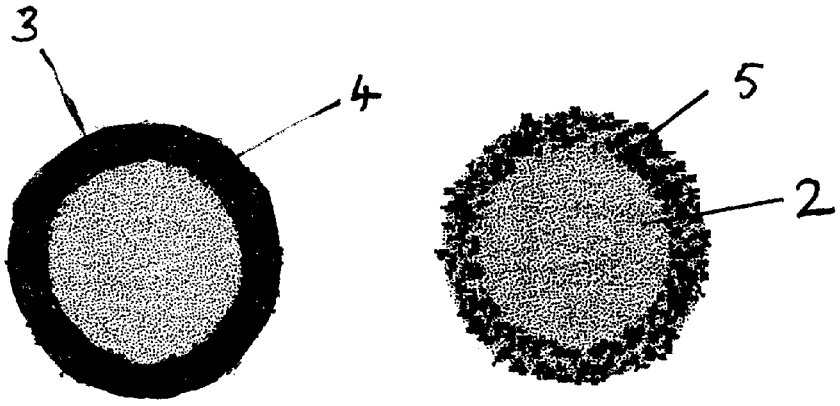
FIG. 2*b* shows back and front views of the disc obtained, with the printed back of the disc on the left and the abrasive-coated surface on the right.

FIG. 2*a* depicts a similar setup to that displayed in FIG. 1 except that the pattern is in the form of a ring and the backing is in the form of a separate disc. FIG. 2*b* shows back, (on the left) and front (on the right) sides of the disc after treatment using the set up in FIG. 2*a*. The back was printed with a ring, 4, in conductive ink and the result is a matching ring of abrasive grain, 5, adhered to the maker coat, 2, on the front side of the backing, 3.

Figure 3:
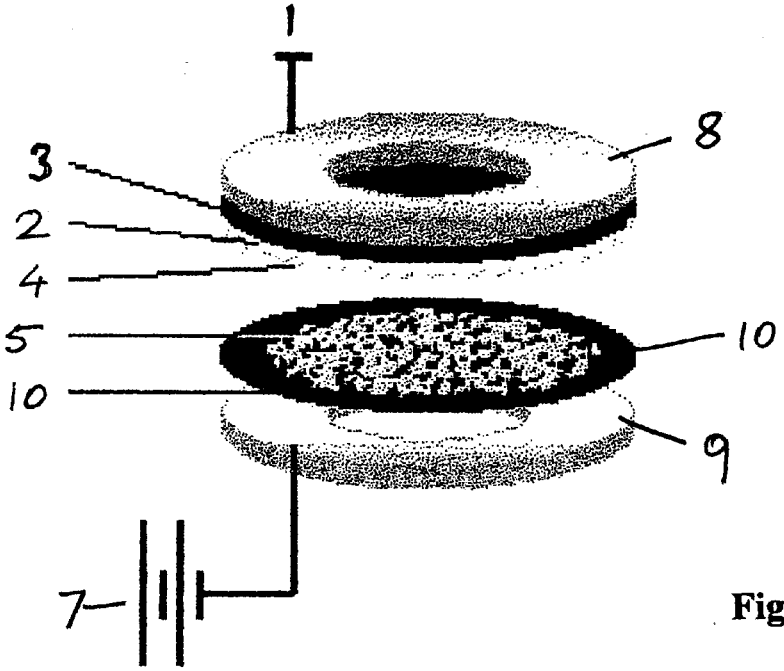
FIG. 3 shows a set-up for the production of individual discs using a ring-shaped ground electrode.

FIG. 3 uses an grounded ring electrode, 8, and an opposed live ring electrode, 9. A support tray, 10, bearing abrasive grain, 5, is opposed by a disc 3, bearing a maker coat, 4. When the live electrode is connected to a power source, 7, grain is projected to the backing disc from the support tray to produce a pattern similar to that shown in FIG. 2*b*.

Figure 4:
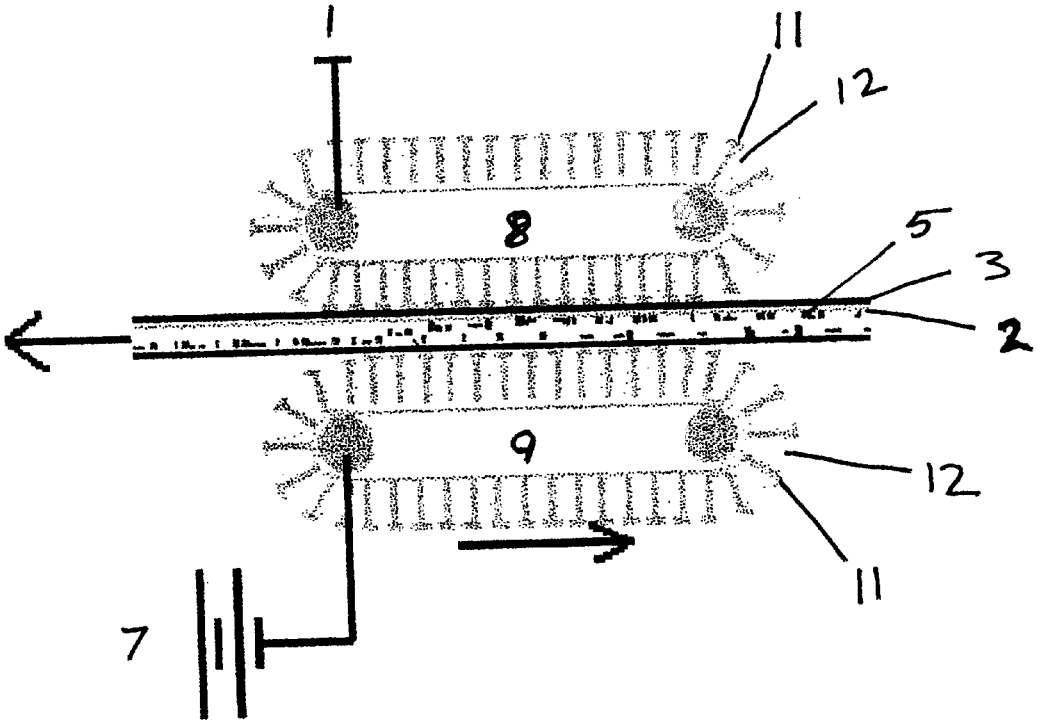
FIG. 4 shows a cross-section of a laminated electrode.

FIG. 4 shows a different arrangement in which the live and grounded electrodes are I the form of laminates comprising a conductive backing plate which has been deeply etched to leave a plurality of conductive elements, 11, and an insulating material, 12, filling the etched spaces between the elements. The electrodes are in the form of belts moving on pulleys to provide an electrode that moves at the speed of the backing material as it moves between the electrodes. In effect the electrodes are a plurality of mini-electrodes such that the field will be a plurality of individual fields rather than one continuous field between two static electrodes. There will therefore be an extended period during which opposed pairs of mini-electrodes will generate a field adequate to propel grain from the conveyor tray to the maker coat on the backing.

Figure 5A:
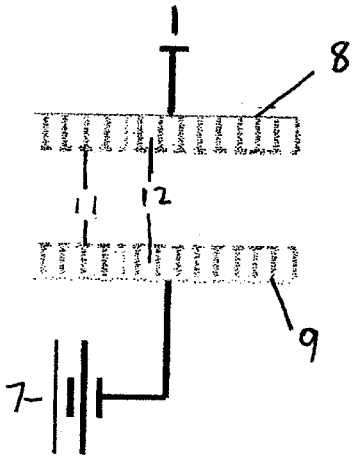
FIGS. 5(*a, b* and *c*) shows in diagrammatic form three different arrangements using such laminated electrodes.
Figure 5B:
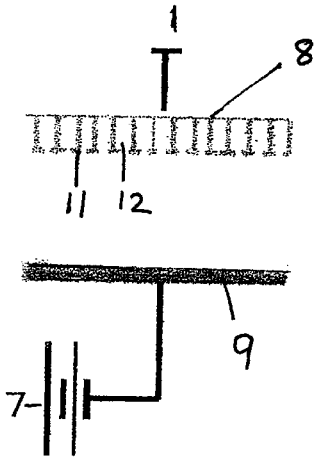
Figure 5C:
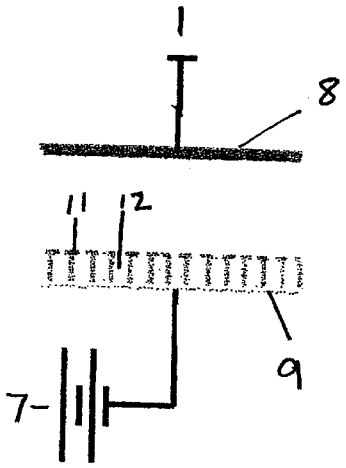

In FIG. 5 it is indicated that it is not necessary that both electrodes be in the laminated form illustrated in FIG. 4 but can be combined with a static electrode which may be either the live or the grounded electrode.

Figure 6:
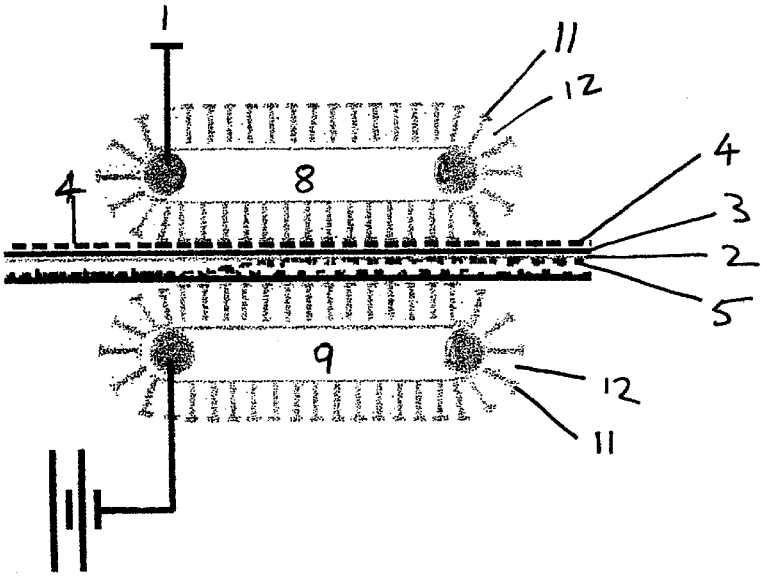
FIG. 6 shows a set-up in which back-printed substrate and laminated electrodes are both employed.

In FIG. 6 the setup illustrated in FIG. 4 is combined with a pattern printed on the reverse side of the backing in conductive ink to accentuate the power of the field between the mini-electrodes.

EXAMPLE 1

Figure 7:
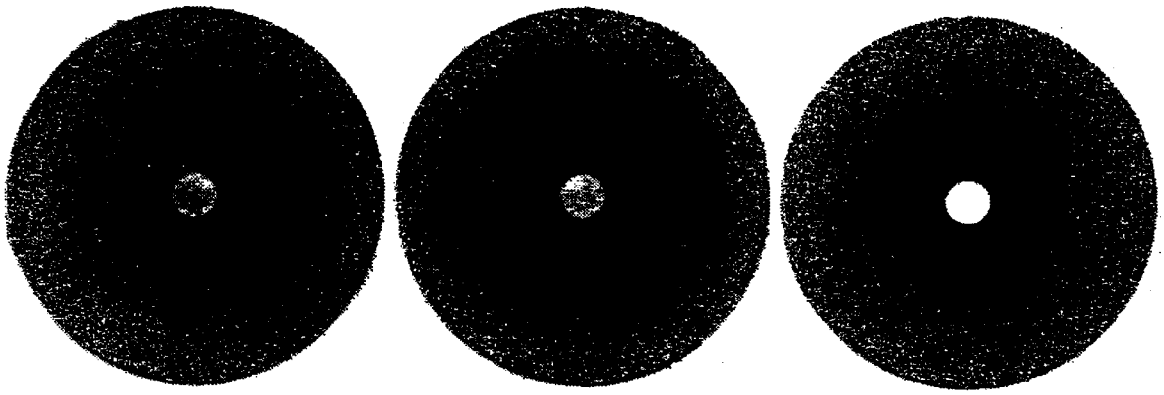
FIG. 7 comprises three scanned images of abrasive discs produced according to the process described in Example 1 below.

In this Example we illustrate the results of the use of a process according to the invention. The apparatus used is as illustrated in FIG. 3 except that the grounded electrode was a flat electrode in place of the ring electrode illustrated in the drawing. The live ring electrode had an outside diameter of 20.32 cm., a radial width of 4.45 cm. A vulcanized fiber backing material coated with a pressure sensitive adhesive, (used as a substitute for the uncured maker coat that would be used in a commercial operation), was attached to the grounded electrode. The separation between the backing material and the live electrode was 1.11 cm. A tray of abrasive grain was placed between the electrodes adjacent the live electrode which was then connected to a 10–30 kV DC power supply. The pattern of deposition is illustrated by the scanned images presented as FIG. 7 which shows three discs coated in this manner with differing times of deposition. They show a clear pattern of deposition in the preferred peripheral area where virtually all the abrasion occurs when using such an abrasive disc.

The invention has been described above in terms of its application to the production of coated abrasives by a variation of a conventional UP deposition process. It is however also adaptable to processes in which a layer of a functional powder is applied over the surface of a layer comprising abrasive gain dispersible in a curable binder. This functional powder is intended to convey specific surface properties and may often comprise fine abrasive grain. A process employing such a coating is described in U.S. Pat. Nos. 5,833,724 and 5,863,306. The coating can be applied using a UP projection technique and it is understood that the use of the present invention in the context of such a process is also considered to be within the intended scope of the invention.

What is claimed is:

1. A process for the production of a coated abrasive with a patterned surface which comprises depositing abrasive grain on an uncharged substrate having a side adapted to receive deposited grain and a back side, by an upward projection electrostatic deposition technique using a field generated by two opposed electrodes bearing different charges wherein the field by which the grain is projected is controlled to provide that the grain is preferentially projected and deposited on the substrate in a desired pattern.

2. A process according to claim 1 in which the field is controlled by printing the back side of the substrate with the desired pattern in a conductive ink.

3. A process according to claim 1 in which the field is controlled by providing that at least one of the electrodes used to generate the electrostatic projection field is shaped to the desired pattern.

4. A process according to claim 3 in which the shaped electrode has an annular form.

5. A process according to claim 1 in which both electrodes used to generate the electrostatic field are shaped to the desired pattern.

6. A process according to claim 1 in which at least one of the electrodes used to generate the projection field is a laminated electrode which has a field generating surface comprising a plurality of conductive elements arranged in a pattern corresponding to the desired pattern, said elements being separated by insulating material and attached to a conductive common support electrode.

7. A process according to claim 1 which is conducted in a continuous fashion wherein the substrate moves between opposed electrodes generating the electrostatic field by which abrasive grain is deposited in the desired pattern.

8. A process according to claim 7 wherein at least one of the electrodes is a laminated electrode which has a field generating surface comprising a plurality of conductive elements arranged in a pattern corresponding to the desired pattern, said elements being separated by insulating material and attached to a conductive common support plate.

9. A process according to claim 8 in which, while grain is being deposited, the laminated electrode moves at the same rate and in the same direction as the substrate.

* * * * *